United States Patent [19]

Alexander

[11] 4,268,074

[45] May 19, 1981

[54] DEVICES FOR LOCKING SLIDING CLOSURES

[76] Inventor: James H. Alexander, 6175 Delmar Blvd., St. Louis, Mo. 63112

[21] Appl. No.: 745,086

[22] Filed: Nov. 26, 1976

[51] Int. Cl.[3] ..... E05C 1/04; E05C 19/18

[52] U.S. Cl. ..... 292/149; 292/152; 292/153; 292/288; 292/291; 292/DIG. 20; 292/DIG. 46

[58] Field of Search ..... 292/3, 10, 32, 33, 42, 292/43, 137, 138, 145, 149, 150, 152, 178, 180, 288, 289, 291, 294, 301, 206, DIG. 20, DIG. 46, DIG. 47, 105; 70/90, 100

[56] References Cited

U.S. PATENT DOCUMENTS

| | | | |
|---|---|---|---|
| 720,496 | 2/1903 | Simpson | 292/DIG. 20 X |
| 836,313 | 11/1906 | Fox | 292/DIG. 20 X |
| 1,125,356 | 1/1915 | Lynn | 292/153 |
| 1,167,175 | 1/1916 | Hicks | 292/42 |
| 1,170,344 | 2/1916 | Ryan | 292/DIG. 20 X |
| 1,244,725 | 10/1917 | Gadke | 292/60 |
| 1,432,640 | 10/1922 | Szalai | 292/145 |
| 2,314,967 | 3/1943 | Bergesch | 292/DIG. 20 X |
| 3,071,957 | 1/1963 | Golub | 292/288 X |
| 3,526,421 | 9/1970 | Hirschler | 292/42 |
| 3,930,678 | 1/1976 | Alexander | 292/288 |

FOREIGN PATENT DOCUMENTS

| | | | |
|---|---|---|---|
| 419548 | 10/1925 | Fed. Rep. of Germany | 292/288 |
| 318801 | 7/1902 | France | 292/149 |
| 27819 | of 1896 | United Kingdom | 292/206 |
| 400325 | 10/1933 | United Kingdom | 292/175 |
| 440843 | 1/1936 | United Kingdom | 292/288 |

*Primary Examiner*—Thomas J. Holko
*Attorney, Agent, or Firm*—Haverstock, Garrett & Roberts

[57] ABSTRACT

A locking device to prevent relative movement between relatively movable members such as between relatively movable sliding window and sliding door members, said relatively movable members having openings which can be placed in registration in predetermined positions of said members, said locking device including a body portion having opposite surfaces and a projecting member attached to and extending from one of the opposite surfaces thereof for insertion into cooperative engagement with the registered openings in the relatively movable members to prevent relative movement therebetween, and another portion of the said locking device for preventing movement of the projecting member after it is inserted including a member extending in spaced substantially parallel relationship to the projecting member for engagement with one of the relatively movable members to be locked, said last named member including in one form of the invention an integral angularly related portion of the body portion which cooperatively engages a surface on one of said relatively movable members angularly related to a surface thereon against which the body portion is positioned. In an alternate embodiment, the last named member includes a member threadedly engageable with one of the said relatively movable members, and said body portion has a portion engageable with said threaded member in a predetermined position thereof.

2 Claims, 18 Drawing Figures

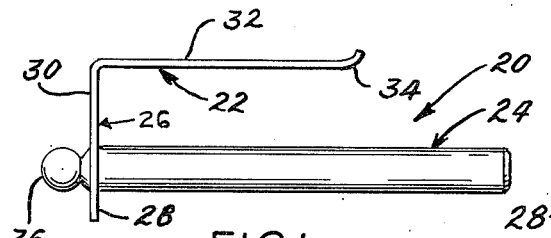
FIG.1
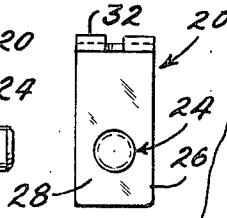
FIG.3
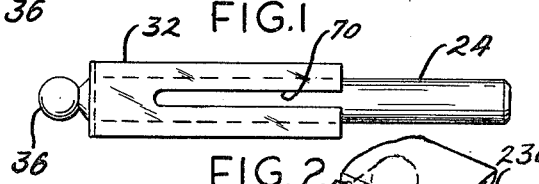
FIG.2
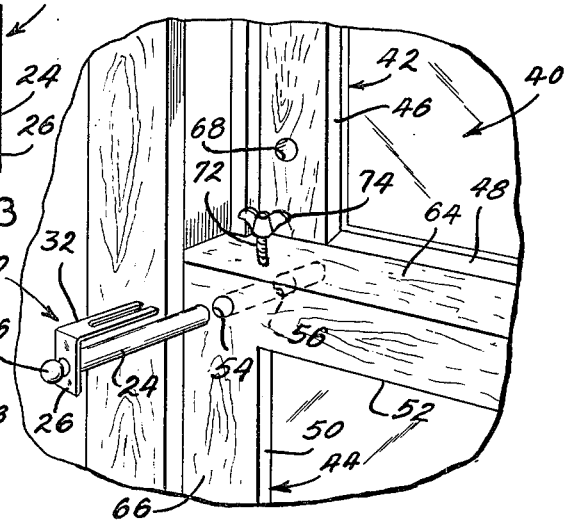
FIG.4
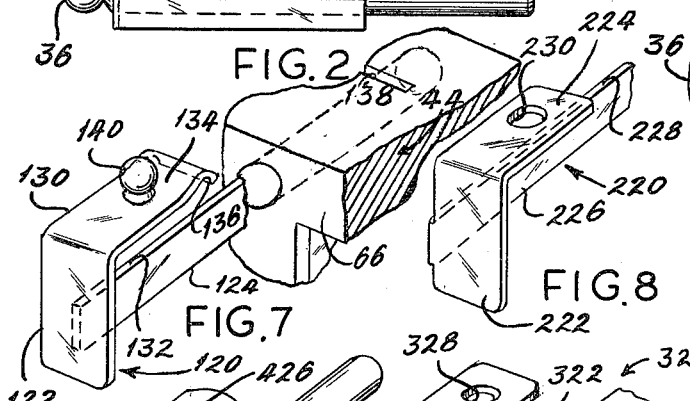
FIG.7
FIG.8
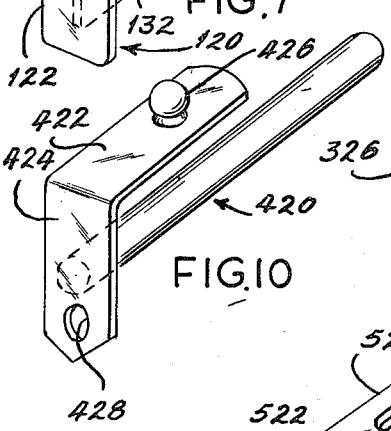
FIG.10
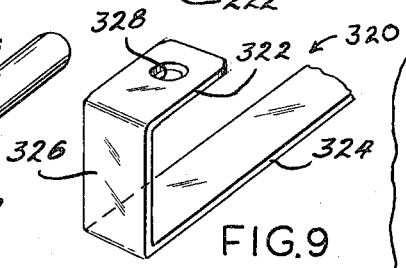
FIG.9
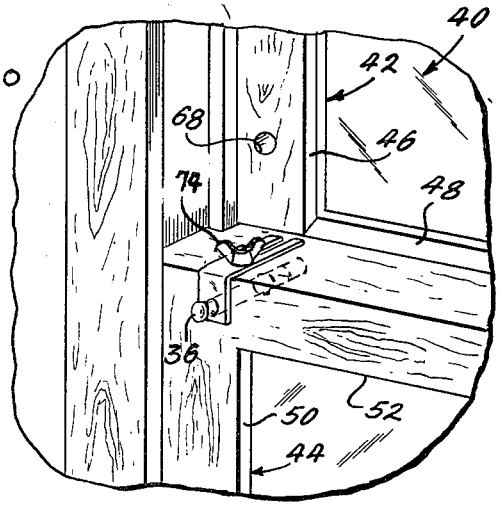
FIG.5
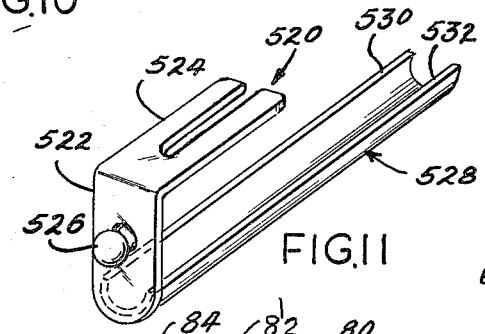
FIG.11
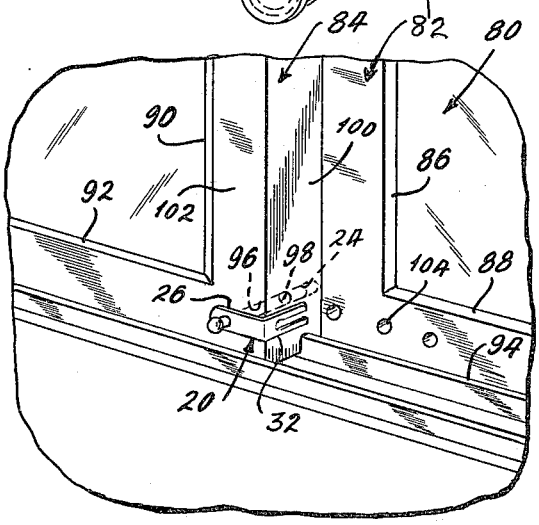
FIG.6
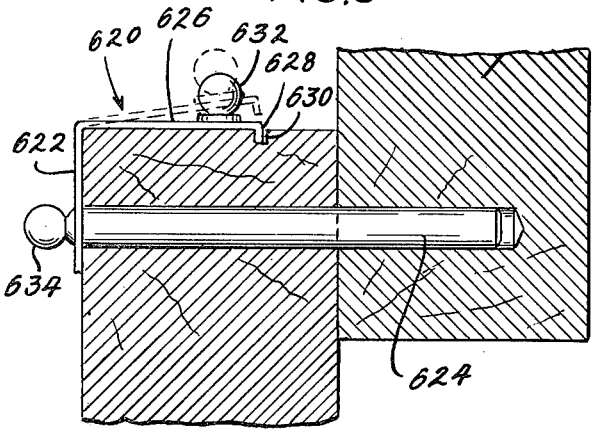
FIG.12

DEVICES FOR LOCKING SLIDING CLOSURES

The present invention relates generally to locking devices, and more particularly to locking devices for preventing relative movement between relatively movable closure members such as between the relatively movable members of sliding window and sliding door assemblies.

In a previous application, now U.S. Pat. No. 3,930,678, Applicant disclosed several forms of locking devices for such use. The present locking means, like Applicant's earlier devices, are relatively simple and inexpensive to manufacture, quick and easy to install and remove, unobtrusive and attractive, and mechanically uncomplicated. They also require relatively few changes or modifications to be made in the closure members for their installation and use. Structurally and functionally, however, the present locking means are quite dissimilar from Applicant's earlier forms, and it is believed that once the present means are installed they may be somewhat more difficult to jimmy and work loose or remove from the outside as well. Furthermore, in some cases, the present means can be installed in even less time and with less effort than is required for the earlier devices, even by persons with relatively little mechanical skill, and with even fewer visible changes in the appearance of the closure members when they are in use.

Many other devices have been proposed for these and similar purposes, one of the more pertinent being disclosed in U.S. Pat. No. 3,071,957. However, this patented lock is comparatively expensive to manufacture and mechanically complicated making it subject to mechanical problems due to wear and abuse. Also, the patented device is relatively time-consuming and difficult to install, and requires considerably more modification and changes to be made in the closure members for its installation including drilling more and larger holes and permanently attaching a relatively large and unsightly keeper plate. Furthermore, with the patented device, a conventional barrel lock operated by a removable key is utilized for more permanently securing the lock in its operative position. Because of this, the patented lock could not be effectively used if the key were to become lost, misplaced or damaged as might easily occur, and in such a case it might even be impossible to install or remove without damaging one of the closure members in the process.

The present locking means overcome these and other shortcomings of the known devices, and provide important advantages over Applicant's patented devices. Briefly, the subject locking means in their preferred forms include a body portion having opposite surfaces thereon, and a projecting member or peg attached to or formed integral with the body portion and extending from one of the opposite surfaces thereof. When the subject means are installed, the body portion engages a surface on one of the relatively movable members to be locked, and the projecting member simultaneously extends through a hole provided therefor through the same member and into an aligned and registered opening extending part way through another of the relatively movable members to prevent relative movement therebetween.

The subject device also includes another portion for preventing movement of the projecting member when the device is installed, which portion includes a member that extends in spaced substantially parallel relationship to the projecting member for engagement with one of the relatively movable members. In some forms of the invention, this other portion of the device includes a member integral with and angularly related to the body portion which engages a surface on one of the relatively movable members when the body portion is positioned in abutment with an angularly related surface thereon. In other modified embodiments, the other portion of the device includes a member threadedly engageable with one of the relatively movable members, and the body portion has a portion engageable with the threaded member in a predetermined position thereof. Means are also provided which may be used as an added security measure for more permanently, yet removably, securing the subject locking means in their operative or locking position to prevent them from being jimmied or otherwise undesirably removed after they are installed. Several forms of securing means are disclosed for this purpose; and, as will be described, the subject securing means are mechanically uncomplicated and do not require any parts such as keys or the like which can be lost or misplaced or become damaged by repeated use.

It is, therefore, a main object of the present invention to provide novel means for locking sliding closure members such as sliding windows and sliding doors, which means are relatively simple structurally, easy to use and inexpensive to manufacture.

Another main object is to provide locking means which are not readily detachable or detectable from outside of a window or door assembly, and which can be secured in place to make them difficult to tamper with.

Another object is to provide locking means which lend themselves to being mass produced using conventional stamping or similar machine operations even from a single piece of sheet material.

Another object is to provide locking means which can be installed with little drilling or other noticeable changes in the appearance of the existing structure.

Another object is to provide locking means which can be used in pairs or other multiples for added security and protection.

Another object is to provide locking means which with slight modification can be used to secure relatively movable closure members such as sliding sash windows and doors in a number of different, preselected positions.

Another object is to provide locking means which can be quickly and easily installed even by persons with relatively little mechanical skill.

Another object is to provide locking means which can be used to retain two or more closure members in various desired and preselected relative positions.

Another object is to provide locking means which can be installed to secure a pair of sliding windows or sliding doors against movement and which do not visibly change or modify the appearance of one of the closure members.

Another object is to provide locking means which are relatively attractive and unobtrusive.

Another object is to provide locking means which can be quickly and easily removed from their locking position when desired.

Yet another object of the invention is to provide locking means which can be secured in their locking position to be substantially burglar resistant without requiring any parts such as keys or the like which can be lost or misplaced or become damaged.

These and other objects and advantages of the present invention will become apparent after considering the following detailed specification which covers several preferred and modified embodiments thereof in conjunction with the accompanying drawings wherein like numerals refer to like parts wherever they occur and wherein:

FIG. 1 is a side elevational view of locking means for sliding closure members constructed according to the present invention;

FIG. 2 is a top plan view of the locking means shown in FIG. 1;

FIG. 3 is a right end elevational view of the locking means shown in FIG. 1;

FIG. 4 is a perspective view showing the subject locking means before they are installed in locking position on a pair of sliding sash windows;

FIG. 5 is a perspective view showing the subject means in locking position on the pair of sliding sash windows;

FIG. 6 is a perspective view showing the locking means installed on a pair of sliding doors;

FIG. 7 is a fragmentary perspective view of a modified form of the subject locking means and showing a portion of one of a pair of sliding sash windows;

FIGS. 8, 9, 10 and 11 are perspective views showing modified forms of the subject locking means;

FIG. 12 is a fragmentary cross-sectional view taken through a double hung window assembly and showing another embodiment of the subject locking means installed in locking position thereon;

Figure 13:
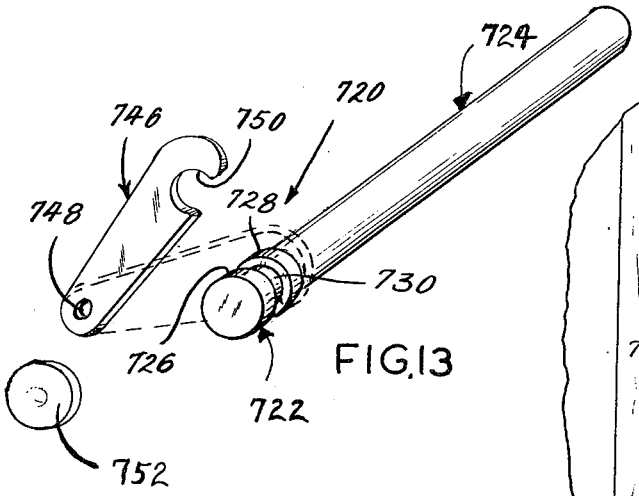
FIGS. 13 and 15 are perspective views of other modified forms of the subject locking means.

Referring to the drawings more particularly by reference numbers, number 20 identifies a locking device for sliding closure members which is constructed according to a preferred form of the invention. As best seen in FIGS. 1–3, the device 20 comprises an elongated body or strip member 22 having a L-shape, and a projecting member or peg 24 extending from one side thereof.

Referring now to FIGS. 1–6, the L-shaped strip member 22 is shown including a body portion 26 having opposite surfaces 28 and 30 and a leg 32 extending from one edge thereof. The leg 32 is preferably formed integral with the portion 26, and for most known sliding window and door constructions it is oriented to be substantially perpendicular to the body portion as shown. A free end 34 of the leg 32 is also preferably curved or upturned slightly as shown in FIG. 1 for reasons to be later explained. The peg 24 is attached to the body portion 26 at a location spaced from the leg 32, and it extends from the surface 28 of the body portion 26 in substantially parallel relationship to the leg 32. The distance between the leg 32 and the peg 24 is important to the subject device as will become apparent. The peg 24 can be attached to the body portion 26 by forming a hole in the body portion (not shown) to receive a portion of the peg that is peened, it can be attached using threaded fasteners (not shown), or it can be welded to the portion 26. The device 20 is also preferably provided with means such as knob 36 which can be threadedly connected to the peg 24 or to the surface 30 of the body portion 26, and used to advantage in installing and removing the device.

The subject locking device 20 can be used to prevent relative movement between known sliding closure members such as between the members of double hung window assembly 40 (FIGS. 4 and 5) or between the members of a sliding door (or window) assembly such as that shown in FIG. 6. In fact, it can be used with almost any two or more overlapping slidably mounted closure members regardless of the spacing between the members, including closure constructions where only one member is movable as well as constructions where both members are movable.

As shown in FIG. 4, the sliding window assembly 40 includes an upper vertically slidable sash 42 and a lower vertically slidable sash 44. The upper sash 42 has connected vertical and horizontal portions 46 and 48, and the lower sash 44 has connected vertical and horizontal stile portions 50 and 52. The sashes 42 and 44 are mounted for sliding movement in spaced sash tracks formed in a jamb structure in the usual manner.

Figure 17:
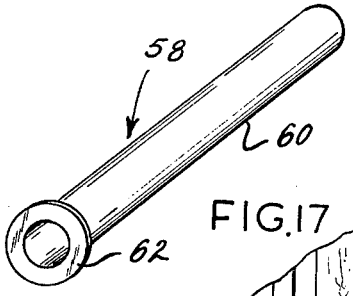
FIG. 17 is a perspective view of an optional protective sleeve member for use with the subject locking means; and, FIG. 18 is a fragmentary perspective view of a double hung window assembly having an optional escutcheon plate member attached to one of its sash members to receive the subject locking means.

To install the subject locking device 20 on a window assembly such as the window assembly 40, it is necessary to provide a hole such as hole 54 which extends completely through the sash 44 and an opening such as opening 56 which extends part way through the upper sash 42, as shown in FIG. 4. The hole 54 and the opening 56 have similar diameters and can be formed, as for example, by first slidably adjusting the sashes 42 and 44 to establish a desired relationship between them such as the relationship in which the window assembly is closed. Thereafter, and while maintaining the relationship, a hole can be drilled through the sash 44 and part way through the sash 42. This can be done in one continuous drilling operation to make sure that the hole 54 and the opening 56 are in alignment and in registration with one another when the sashes are positioned in their desired relationship. This is necessary for the subject device to be installed. The total depth of the drill hole should be equal to or slightly greater than the length of the peg 24 so that the peg can be inserted into the hole 54 and the opening 56. Also, the diameter of the hole 54 and the opening 56 depends on the diameter of the peg 24, and should be slightly larger than the diameter of the peg to make it farily easy to insert and withdraw the peg 24 even if the sash members become wet and swell up to some extent. In the illustrated case, a somewhat larger diameter drill hole is used in order for the hole and possibly the opening to accommodate optional tubular hole liners or sleeves such as sleeve 58 shown in FIG. 17. The sleeves 58 have cylindrical body portions 60 with outer diameters of sufficient size so that they must be force fitted into the hole 54 and the opening 56, and with inside diameters which are such as to just receive the peg 24. The sleeves 58 may also be provided with reinforced lip portions such as lip 62 so that they may be force fitted into the hole and the opening such as by tapping them with a hammer or the like without being damaged with the lip providing a finished appearance. The optional liners 58, when used, can be made of metal, plastic or some other suitable preferably rustproof material that will provide a relatively smooth channel into and from which the peg 24 can be relatively easily inserted and withdrawn.

The hole 54 should be located at a position on the vertical stile portion 50 of the lower sash 44 such that the leg 32 will engage upper surface 64 thereof when the device is installed. When installed, the surface 28 of the body portion 26 should also abut front surface 66 of the sash 44. These engagements of the leg 32 and the portion 26 of the L-shaped strip member are important as they prevent the peg 24 from turning or rotating after it is inserted and also help to prevent removal of the device by an intruder. As will be described, however, additional means may also be provided for more permanently securing the device in its locking position on the window assembly, if desired. To install the device 20 on the window assembly 40, it is merely necessary to align the hole 54 and the opening 56 and to insert the peg 24 until the body portion 26 abuts the front surface 66 of the lower sash 44.

In FIGS. 4 and 5, the sashes 42 and 44 are illustrated in their respective closed positions; and, if it is only desired to lock or retain the sashes in this position, this can be done without requiring any holes in the window assembly that are visible when the device 20 is installed. If it is desired to be able to lock the window assembly in different partly open positions, however, this can be done by providing additional spaced openings such as opening 68 in the vertical portion 46 of the sash 42. The opening 68 is similar to the opening 56 above, and may be drilled using the hole 54 as a guide. If desired, the opening 68 may also be provided with a hole liner or sleeve such as the sleeve 58.

Additional means may also be provided with the subject device for more permanently, yet removably, securing it in its locking position on the window assembly. One form of such means is shown in FIGS. 2 and 4–6, and includes forming a slot 70 in the leg 32 as best seen in FIG. 2, and installing means such as threaded pin member 72 or the like on the lower sash 44. The pin member 72 can be installed by threading it partly into the sash 44 or in some other suitable manner if preferred, and it extends upwardly from the lower sash 44 to cooperate with the slot 70 when the device is installed and to threadedly receive a member such as wing nut 74. When such securing means are used, the device 20 can be secured after being installed by simply tightening down the wing nut 74 against the spaced portions of the leg 32. By loosening the wing nut 74, the device 20 can be easily removed using the knob 36 if desired. It will be recognized that the device 20 can be installed, secured and removed from the window assembly 40 without ever requiring that the wing nut 74 be completely removed from the pin member 72. Also, this form of securing means has the advantage of being relatively simple and inexpensive to manufacture, and easy to install. It is of further note that the free end 34 of the slotted leg 32 is preferably bent upwardly to some extent so that if the wing nut 74 becomes loosened it will still be difficult or impossible to remove the device 20 without further loosening of the wing nut 74. For still further security, it is contemplated that more than one device 20 per window assembly may be used, although one is usually all that is required.

In FIG. 6, the locking device 20 is shown installed in a somewhat similar fashion on a sliding door assembly 80. The sliding door assembly 80 is shown including relatively movable door members 82 and 84 which, respectively, include vertical and horizontal stile portions 86 and 88, and 90 and 92. In the construction shown, one of the door members, namely the door 82, is stationary as is often the case while the other door member 84 is mounted on a track 94 for slidable movement. In this instance, the device 20 is installed with the leg 32 oriented in a vertical instead of a horizontal plane and with the peg 24 extending through a hole 96 in the door member 84 and into an aligned and registered opening 98 in the door assembly 82. The leg 32 and the body portion 26 of the L-shaped strip member, respectively, engage a pair of adjacent side surfaces 100 and 102 on the door member 84 in a manner similar to the way that they engage the window assembly 40. Additional receiving holes 104, similar to the holes 68 above, may also be provided in the horizontal stile portion 88 of the door 82 so that the door assembly 80 can be locked in selected open positions, if desired. Also, means such as the pin member 72 and the wing nut 74 (FIG. 4) may be used for more permanently securing the device in place.

Figure 18:
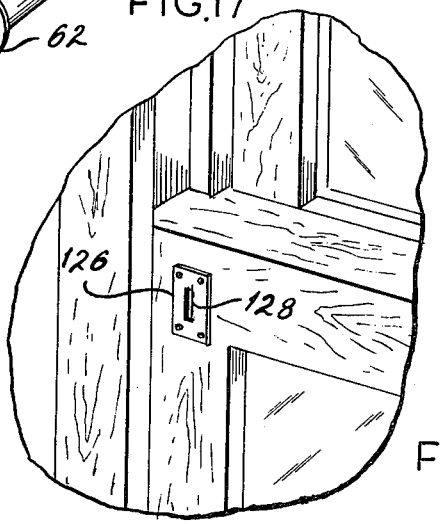

In FIG. 7, a modified form 120 of the subject locking means is shown along with a corner of the sash 44. The locking device 120 includes a body portion 122 which has a projecting tongue member 124 attached at a suitable location and extending therefrom as shown. The tongue member 124, like the peg member 24, can be inserted to simultaneously cooperatively engage a hole and a registered opening provided in the sashes 44 and 42 when the device 120 is installed. The hole and the opening required for receiving the tongue member 124 may be formed similarly to the hole 54 and the opening 56 described above, and may have circular shapes with diameters sufficient to receive the tongue member 124. Alternatively, larger diameters may be used along with sleeve members such as the sleeve member 58, or along with an optional plate member such as plate member 126 shown in FIG. 18. The plate member 126, when used, may be attached to the sash 44 with threaded or similar fasteners, and it has an aperture 128 therein that is positioned, shaped and oriented so as to guide the tongue member 124 as it is inserted therethrough and into the hole and the opening provided in the sashes 44 and 42. In the illustrated case, the aperture 128 is rectangular and vertically oriented to match the cross-sectional shape of the projecting tongue member 124, although this may vary depending on the particular shape and orientation selected for the projecting member 124.

The locking device 120 has a leg 130 which engages the surface of the sash 44 when the tongue member 124 is inserted to position the body portion 122 of the device in abutment with the sash 44. This helps to prevent movement of the tongue member and unauthorized removal of the device after it is installed. The leg 130 is formed integrally with the body portion 122 preferably of a material such as steel or the like, and it extends a distance from one edge of the body portion 122 in spaced and substantially parallel relationship to side edge surface 132 of the tongue member 124. Thereafter, the leg 130 curves upwardly slightly or away from the tongue 124 (as at 134), and a free end 136 of the leg 130 projects downwardly or toward the tongue member 124 for cooperative engagement with means such as groove 138 provided therefor on the sash 44. The free end 136 of the leg 130 projects downwardly to an extent such that in order to completely insert the tongue member 124 it is necessary to raise or move the leg 130 away from the sash member to provide clearance for the free end 136 to move thereover and into engagement with the groove 138. This may be done with the tongue member 124 partially inserted by lifting on a knob 140 included for this purpose. When the tongue member 124 is completely inserted and the knob 140 released, the free end 136 cooperatively engages the groove 138. Removing the device 120 from its locking position can be accomplished by lifting the leg upwardly using the knob 140 until the free end 136 clears the groove 138, and withdrawing the tongue member 124. The device 120 can be utilized in a similar fashion to lock horizontally sliding window and door assemblies. The locking device 120 may be preferable over other forms of the subject device in some situations in that it may be installed and secured in place in essentially a single operative step.

FIGS. 8 and 9 show other modified embodiments 220 and 320 of the subject locking means that can be made from a single piece or sheet of material. The device 220, as shown in FIG. 8, includes a relatively flat body portion 222 having an integral right angle leg 224 extending from a first edge, and having an integral projecting member or tongue 226 extending from a second edge thereof. A side edge 228 of the tongue 226 is characteristically spaced and substantially parallel with the leg 224. By way of comparison, the device 320 is basically similar to the device 220, except that it has a leg 322 and a tongue 324 formed integrally with and extending from spaced opposite edges of a relatively flat body portion 326. The devices 220 and 320 can be installed in a manner similar to the device 20, and optional plate members similar to the plate member 126 (FIG. 18) may be used, if desired. If the optional plate members are used, they should have apertures in them which match the shapes and orientations of the respective tongues 226 and 324. After being installed, the devices 220 and 320 can be more permanently secured by attaching the legs 224 and 322 of the respective devices to surfaces of the sashes against which they are positioned when the devices are installed. This can be done by providing apertures 230 and 328 and fastening means such as screws or the like (not shown). These forms of the device have advantages in that they may be less expensive to construct using readily available stamping and forming devices.

FIG. 10 is included to show another modified form 420 of the subject locking device which in many respects is similar to the locking device 20. Unlike the device 20, however, leg 422 of the device 420 does not have a slot formed in it. Also, the device 420 has an aperture 428 which is used for the same purpose as the apertures 230 and 328 mentioned above. The device 420 also has a knob 426 to facilitate its installation and removal. The device 420 is otherwise similar to the device 20, and it can be installed and used in a generally similar fashion.

FIG. 11 shows another form 520 of the subject locking means which also has several features similar to the features of the locking device 20. For example, the device 520 is shown including a body portion 522 which has integral bifurcated leg 524 extending from one edge thereof. The device 520 has a knob 526 attached to the body portion 522 to facilitate installing and removing it, and the device has a projecting member 528 attached to and extending from the body portion 522. The projecting member 528 is semi-circular in cross-section and has a pair of spaced opposite side surfaces 530 and 532 thereon which lie in a plane spaced and substantially parallel to the plane of the leg 524. This form of the device can be installed in a manner similar to either of the devices 220 or 320; but, if a plate member such as the plate 126 is used, it should have an aperture therein shaped to receive the projecting member 528. After being installed, the device 520 can be more permanently secured in the same way as the device 20. This construction can also be made from a single piece of sheet material with the projecting member 528 formed into a closed member or tube if desired.

Another embodiment 620 of the subject locking means is illustrated in FIG. 12 in its installed or locking position, and this form combines features of both the device 20 and the device 120. As shown, the device 620 includes a body portion 622 which has an attached peg 624 extending therefrom for the same purpose as the peg 24. The device 620 also has a leg 626 formed integrally with the body portion 622, and preferably made of a material such as spring steel or the like. The leg 626 extends from one edge of the body portion 622 in spaced and substantially parallel relation to the peg 624. As in the case of the locking device 120, a free end portion 628 of the leg 626 projects toward the peg 624, and cooperatively engages means such as groove 630 when the device is installed to hold it in place. Installing the locking device 620 on a sliding window or door assembly can be accomplished in a manner similar to the device 120, and requires that the leg 626 be moved to a position such as shown in dotted outline to provide clearance for the free end 628. A knob 632 is attached to the leg 626 for this purpose, and a second knob 634 is attached to the body portion 622 of the device to further facilitate installing and removing it.

Figure 14:
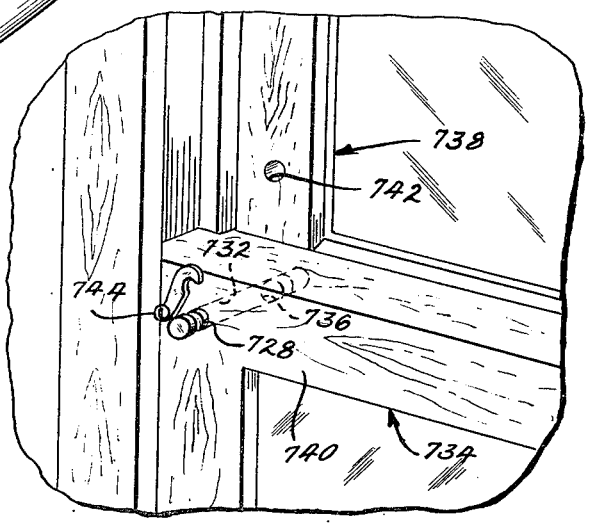
FIGS. 14 and 16 are perspective views which respectively show the locking means of FIGS. 13 and 15 installed in locking position on pairs of sliding sash windows.

In FIG. 13, still another modified embodiment 720 is shown, and FIG. 14 shows the locking device 720 being installed in a locking position on a window assembly similar to the window assembly 40. As shown, the device 720 includes a body portion generally identified by the reference number 722, and projecting member or peg 724 that can be formed integral with the body portion 722 or attached thereto by means such as welding or the like. The body portion 722 of the device 720 is shown including spaced opposite end portions 726 and 728, and a neck portion 730 of a reduced size or diameter which extends between and connects the portions 726 and 728. The peg 724 extends from the portion 728, and is of a size and shape to be inserted through a hole 732 in lower sash member 734 and into an aligned and registered opening 736 which extends part way through upper sash member 738. The hole 732 and the opening 736 may be formed in a manner similar to the hole 54 and the opening 56 above, and may likewise be provided with optional sleeve members such as the sleeve member 58. When installed, the peg 724 simultaneously cooperatively engages the hole 732 and the opening 736 to prevent relative movement between the sash members 734 and 738, and the end portion 728 of the body portion 722 is positioned against side surface 740 of the lower sash member 734. Additional spaced openings such as opening 742, similar to the openings 68 above, may be provided, if desired.

The device 720 also includes means for securing the peg 724 in the hole and the opening after it is inserted. A preferred form of such means is shown, and includes a member such as screw 744 and an arm 746. The screw 744, extends through an opening 748 near one opposite end of the arm 746, and into the lower sash 734. The shaft of the screw 744 extends in spaced and substantially parallel relationship to the peg 724 when the device is installed. The arm 746 is movable on the shaft of the screw 744, and it has means such as hook 750 near its free end which by moving the arm 746 to the position shown in dotted outline in FIG. 13 cooperatively engage the reduced diameter neck portion 730 of the body portion 722 to secure the device in place. Obviously, the distance between the screw 744 and peg 724 is important to allow engagement between the hook 750 and the neck portion 730. Also, it is contemplated that a spacer member such as a washer 752 can be positioned on the shaft of the screw 744 between the arm 746 and the lower sash 734 to properly position the arm for engaging the neck portion 730 and to prevent possible marking of the lower sash member 734. The device 720 can be similarly employed to lock horizontally sliding window and door assemblies.

Figure 15:
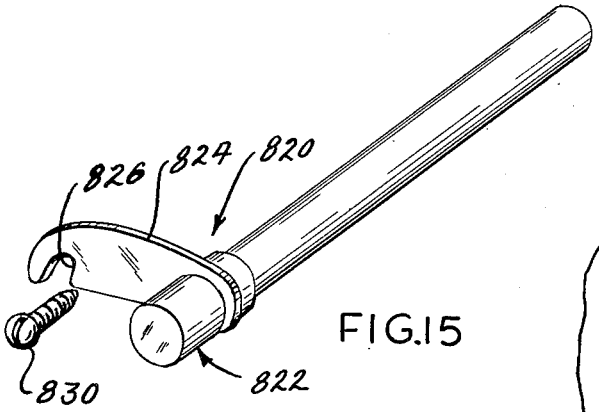
Figure 16:
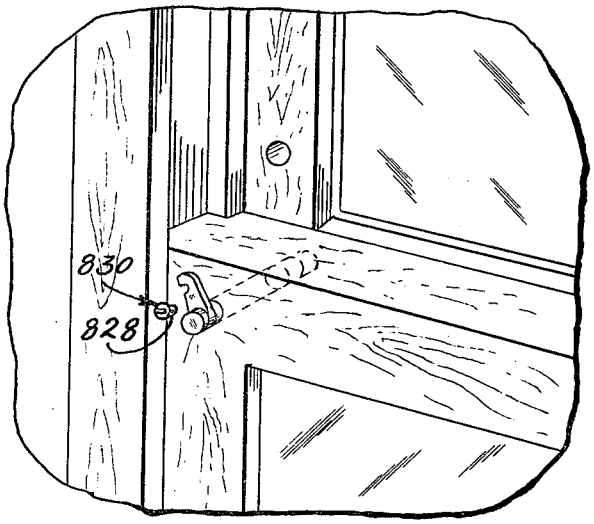

A slightly modified form 820 of the locking device 720 is shown in FIG. 15, and FIG. 16 shows the device 820 installed in a locking but unsecured position on a window assembly similar to the window assembly 40. The device 820 is basically similar to the device 720 and it can be installed and secured in a similar fashion. In this case, however, body portion 822 of the device 820 has one end of an arm 824 fixedly attached thereto and extending substantially perpendicularly from an intermediate location such as shown. The arm 824 is generally similar to the arm 746, and has means such as hook 826 near the free end thereof. After the device 820 is installed, it can be secured in place by rotating the arm 824 until the hook 826 cooperatively engages an extending shaft portion 828 of a threaded member 830 similar to the screw 744.

Thus there has been shown and described several forms of novel locking means for preventing relative movement between relatively movable closure members such as between sliding windows and sliding doors, which locking means fulfill all of the objects and advantages sought therefor. Many further changes, modifications alterations and other uses and applications of the subject means are contemplated, however, and will become apparent to those skilled in the art after considering this specification and the accompanying drawings. All such changes, modifications, alterations and other uses and applications which do not depart from the spirit and scope of the invention are deemed to be covered by the invention which is limited only by the claims which follow.

What is claimed is:

1. A device for preventing relative movement between relatively movable first and second members of sliding window and sliding door assemblies, said first member having a first surface, an adjacent second surface and a single hole extending from said second surface through the first member at a location spaced from said first surface, the second of said relatively movable members having a surface with an opening extending therefrom partway therethrough, at least one of said first and second members being movable relative to the other to locate the single hole in registration with the opening, said device comprising a one-piece locking member having a relatively flat body portion with opposite sides and a side edge, a leg having a relatively flat portion formed integral with said side edge and extending angularly from one of the opposite sides of said body portion, and a projecting member fixedly attached to and extending from said body portion in spaced substantially parallel relationship to the flat portion of said leg, said projecting member having a length and cross-sectional shape to be inserted into simultaneous cooperative engagement with said hole and said opening when in registration, insertion of said projecting member moving said relatively flat body portion into relatively flush abutment with said second surface on said first relatively movable member to limit penetration of said projecting member into said opening, the relatively flat portion of said leg simultaneously moving into substantially flush engagement with said first surface to prevent rotational movement of the projecting member in said hole and said opening, separate means for attaching the locking member to said first relatively movable member after the locking member is positioned in locking engagement with the first and second relatively movable members, said separate means for attaching the locking member to said first relatively movable member including a threaded member, the threaded member being engaged with said first relatively movable member and having a portion extending from said first surface at a location spaced from said second surface, said leg having a slot formed therein for cooperatively receiving said threaded member during installation of the device, and means engageable with said extending portion of said threaded member and with said leg to lock the device in installed position.

2. A device defined in claim 1 wherein said means engageable with said extending portion of said threaded member and with said leg include a threaded locking member, and said leg of said locking device has portions that extend outwardly from said first surface further than the relatively flat portion thereof when the device is installed.

* * * * *